US007836941B2

(12) United States Patent
Song et al.

(10) Patent No.: US 7,836,941 B2
(45) Date of Patent: Nov. 23, 2010

(54) MITIGATION OF IN-TUBE FOULING IN HEAT EXCHANGERS USING CONTROLLED MECHANICAL VIBRATION

(75) Inventors: Limin Song, West Windsor, NJ (US); Julio D. Lobo, Alexandria, VA (US); Glen B. Brons, Phillipsburg, NJ (US); San Chhotray, Centreville, VA (US); Himanshu M. Joshi, Chester, NJ (US); George A. Lutz, Brick, NJ (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 1090 days.

(21) Appl. No.: 11/436,802

(22) Filed: May 19, 2006

(65) Prior Publication Data

US 2007/0267176 A1 Nov. 22, 2007

(51) Int. Cl.
*F28G 1/12* (2006.01)
*F28D 1/06* (2006.01)

(52) U.S. Cl. ..... 165/95; 165/84

(58) Field of Classification Search ..... 165/95, 165/157, 158, 109.1, 173, 84; 15/104.03, 15/104.05, 104.07
See application file for complete search history.

(56) References Cited

U.S. PATENT DOCUMENTS 2,858,900 A * 11/1958 Foley ..... 96/25
3,183,967 A 5/1965 Mettenleiter et al.
3,389,974 A * 6/1968 Scarfi et al. ..... 23/295 R
3,835,817 A 9/1974 Tuomaala
3,920,085 A * 11/1975 Bourke ..... 96/34
4,035,165 A * 7/1977 Archer ..... 95/25
4,162,617 A 7/1979 Schmidt et al.
4,221,573 A * 9/1980 Hankins ..... 96/35
4,653,578 A * 3/1987 Horning ..... 165/84
4,741,292 A 5/1988 Novak
4,841,917 A * 6/1989 Premel ..... 122/379
4,891,190 A 1/1990 Carter
4,993,098 A 2/1991 Kharitonov et al.
5,238,055 A 8/1993 Kelley
5,315,966 A 5/1994 Gamache et al.

(Continued)

FOREIGN PATENT DOCUMENTS

EP 0 803 287 A 10/1997

(Continued)

OTHER PUBLICATIONS

International Search Report, PCT Application No. PCT/US2007/011827, Nov. 26, 2007.

(Continued)

*Primary Examiner*—Tho v Duong
(74) *Attorney, Agent, or Firm*—Glenn T. Barrett

(57) ABSTRACT

Fouling of heat exchange surfaces is mitigated by a process in which a mechanical force is applied to a fixed heat exchanger to excite a vibration in the heat exchange surface and produce shear waves in the fluid adjacent the heat exchange surface. The mechanical force is applied by a dynamic actuator coupled to a controller to produce vibration at a controlled frequency and amplitude output that minimizes adverse effects to the heat exchange structure. The dynamic actuator may be coupled to the heat exchanger in place and operated while the heat exchanger is on line.

10 Claims, 5 Drawing Sheets

U.S. PATENT DOCUMENTS

| | | | |
|---|---|---|---|
| 5,540,275 | A | 7/1996 | Eisinger |
| 5,873,408 | A | 2/1999 | Bellet et al. |
| 6,460,628 | B1 | 10/2002 | Day et al. |

FOREIGN PATENT DOCUMENTS

| | | | |
|---|---|---|---|
| GB | 532 144 | A | 1/1941 |
| GB | 846 994 | A | 9/1960 |
| JP | 60 023794 | A | 2/1985 |

OTHER PUBLICATIONS

Written Opinion, PCT Application No. PCT/US2007/011827, Nov. 26, 2007.
Australian Patent Office Examination Report, Form APO/SG/409, 4pgs.
Australian Patent Office Search Report, Form APO/SG/210, 3pgs.

* cited by examiner

MITIGATION OF IN-TUBE FOULING IN HEAT EXCHANGERS USING CONTROLLED MECHANICAL VIBRATION

BACKGROUND OF THE INVENTION

1. Field of the Invention

This invention relates to heat exchangers used in refineries and petrochemical plants. In particular, this invention relates to mitigation of fouling in heat exchangers.

2. Discussion of Related Art

Fouling is generally defined as the accumulation of unwanted materials on the surfaces of processing equipment. In petroleum processing, fouling is the accumulation of unwanted hydrocarbons-based deposits on heat exchanger surfaces. It has been recognized as a nearly universal problem in design and operation of refining and petrochemical processing systems, and affects the operation of equipment in two ways. First, the fouling layer has a low thermal conductivity. This increases the resistance to heat transfer and reduces the effectiveness of the heat exchangers—thus increasing temperature in the system. Second, as deposition occurs, the cross-sectional area is reduced, which causes an increase in pressure drop across the apparatus and creates inefficient pressure and flow in the heat exchanger.

Heat exchanger in-tube fouling costs petroleum refineries hundreds of millions of dollars each year due to lost efficiencies, throughput, and additional energy consumption. With the increased cost of energy, heat exchanger fouling has a greater impact on process profitability. Petroleum refineries and petrochemical plants also suffer high operating costs due to cleaning required as a result of fouling that occurs during thermal processing of whole crude oils, blends and fractions in heat transfer equipment. While many types of refinery equipment are affected by fouling, cost estimates have shown that the majority of profit losses occur due to the fouling of whole crude oils and blends in pre-heat train exchangers.

Fouling in heat exchangers associated with petroleum type streams can result from a number of mechanisms including chemical reactions, corrosion, deposit of insoluble materials, and deposit of materials made insoluble by the temperature difference between the fluid and heat exchange wall.

One of the more common root causes of rapid fouling, in particular, is the formation of coke that occurs when crude oil asphaltenes are overexposed to heater tube surface temperatures. The liquids on the other side of the exchanger are much hotter than the whole crude oils and result in relatively high surface or skin temperatures. The asphaltenes can precipitate from the oil and adhere to these hot surfaces. Prolonged exposure to such surface temperatures, especially in the late-train exchanger, allows for the thermal degradation of the asphaltenes to coke. The coke then acts as an insulator and is responsible for heat transfer efficiency losses in the heat exchanger by preventing the surface from heating the oil passing through the unit. To return the refinery to more profitable levels, the fouled heat exchangers need to be cleaned, which typically requires removal from service, as discussed below.

Heat exchanger fouling forces refineries to frequently employ costly shutdowns for the cleaning process. Currently, most refineries practice off-line cleaning of heat exchanger tube bundles by bringing the heat exchanger out of service to perform chemical or mechanical cleaning. The cleaning can be based on scheduled time or usage or on actual monitored fouling conditions. Such conditions can be determined by evaluating the loss of heat exchange efficiency. However, off-line cleaning interrupts service. This can be particularly burdensome for small refineries because there will be periods of non-production.

Mitigating or possibly eliminating fouling of heat exchangers can result in huge cost savings in energy reduction alone. Reduction in fouling leads to energy savings, higher capacity, reduction in maintenance, lower cleaning expenses, and an improvement in overall availability of the equipment.

Attempts have been made to use vibrational forces to reduce fouling. U.S. Pat. No. 3,183,967 to Mettenleiter discloses a heat exchanger, having a plurality of heating tubes, which is resiliently or flexibly mounted and vibrated to repel solids accumulating on the heat exchanger surfaces to prevent the solids from settling and forming a scale. This assembly requires a specialized resilient mounting assembly however and could not be easily adapted to an existing heat exchanger. U.S. Pat. No. 5,873,408 to Bellet et al. also uses vibration by directly linking a mechanical vibrator to a duct in a heat exchanger. Again, this system requires a specialized mounting assembly for the individual ducts in a heat exchanger that would not be suitable for an existing system.

Thus, there is a need to develop methods for reducing in-tube fouling, particularly for use with existing equipment. There is a need to mitigate or eliminate fouling while the heat exchanger equipment is online. There is also a particular need to address fouling in pre-heat train exchangers in a refinery.

BRIEF SUMMARY OF THE INVENTION

Aspects of embodiments of the invention relate to a process for inducing shear waves adjacent the surface of a heat exchanger to interfere with fouling mechanisms.

Another aspect of embodiments of the invention relates providing a process that can be implemented in an existing system, such as a refinery.

An additional aspect of embodiments of the invention relates to practicing the process of mitigating fouling while the heat exchanger is operational.

These and other aspects can be realized by the present invention, which is directed to a process for reducing fouling in a heat exchanger, comprising the steps of providing a heat exchanger with tubes for liquid flow and a fixed mounting element that supports the tubes, and applying a mechanical force to the fixed mounting element to induce a vibration in the tubes that causes shear motion in the liquid flowing adjacent to the tubes to reduce fouling of the tubes.

Applying the mechanical force includes controlling the application of force to induce controlled vibrational energy. The process can also include sensing vibrational energy induced in the tubes and adjusting control of the application of force based on the sensed vibrational energy. Vibration is especially effective at a high frequency of 1000 Hz or greater.

The mechanical force can be applied directly or indirectly to the fixed mounting element and can be applied in an axial or transverse direction with respect to the tubes. The mechanical force can be applied by a dynamic actuator or array of actuators, including for example, a hammer, a shaker or a piezoelectric stack.

The heat exchanger can be a shell-tube heat exchanger with the tubes formed as a tube bundle and the fixed mounting element formed as a tube-sheet flange. The heat exchanger can be an existing heat exchanger in place in a processing system and applying the mechanical force can include retrofitting the existing heat exchanger with a dynamic actuator. The heat exchanger can be on-line in a refining system.

The invention also relates to a kit for retrofitting a refining system having a heat exchanger fixed in place. The heat exchanger includes a tube bundle of tubes for flowing fluid therethrough to effect heat exchange and a flange for supporting the tube bundle. The kit comprises a dynamic actuator including a force producing device with an actuator and a mounting device for connecting the force producing device to the heat exchanger fixed in place, and a controller connected to the dynamic actuator to control the actuator to cause the force producing device to induce a controlled application of vibrational energy to the tubes to cause shear motion in the liquid flowing adjacent to the tubes to reduce fouling of the tubes.

These and other aspects of the invention will become apparent when taken in conjunction with the detailed description and appended drawings.

BRIEF DESCRIPTION OF THE DRAWINGS

The invention will now be described in conjunction with the accompanying drawings in which.

In the drawings, like reference numerals indicate corresponding parts in the different figures.

DETAILED DESCRIPTION OF PREFERRED EMBODIMENTS

This invention is directed to a method of mitigating fouling in heat exchangers, in general, and the devices for practicing the method. In a preferred use, the method and devices are applied to heat exchangers used in refining processes, such as in refineries or petrochemical processing plants. The invention is particularly suited for retrofitting existing plants so that the process may be used in existing heat exchangers, especially while the heat exchanger is on line and in use. Of course, it is possible to apply the invention to other processing facilities and heat exchangers, particularly those that are susceptible to fouling in a similar manner as experienced during refining processes and are inconvenient to take off line for repair and cleaning.

While this invention can be used in existing systems, it is also possible to initially manufacture a heat exchanger with the vibration inducing devices described herein and use the method in accordance with this invention in new installations.

Heat exchange with crude oil involves two important fouling mechanisms: chemical reaction and the deposition of insoluble materials. In both instances, the reduction of the viscous sub-layer (or boundary layer) close to the wall can mitigate the fouling rate. This concept is applied in the process according to this invention.

In the case of chemical reaction, the high temperature at the surface of the heat transfer wall activates the molecules to form precursors for the fouling residue. If these precursors are not swept out of the relatively stagnant wall region, they will associate together and deposit on the wall. A reduction of the boundary layer will reduce the thickness of the stagnant region and hence reduce the amount of precursors available to form a fouling residue. So, one way to prevent adherence is to disrupt the film layer at the surface to reduce the exposure time at the high surface temperature. In accordance with this invention, the process includes vibrating the wall to cause a disruption in the film layer.

In the case of the deposition of insoluble materials, a reduction in the boundary layer will increase the shear near the wall. By this, a greater force is exerted on the insoluble particles near the wall to overcome the particles' attractive forces to the wall. In accordance with the invention, vibration of the wall in a direction perpendicular to the radius of the tube will produce shear waves that propagate from the wall into the fluid. This will reduce the probability of deposition and incorporation into the fouling residue.

Figure 1:
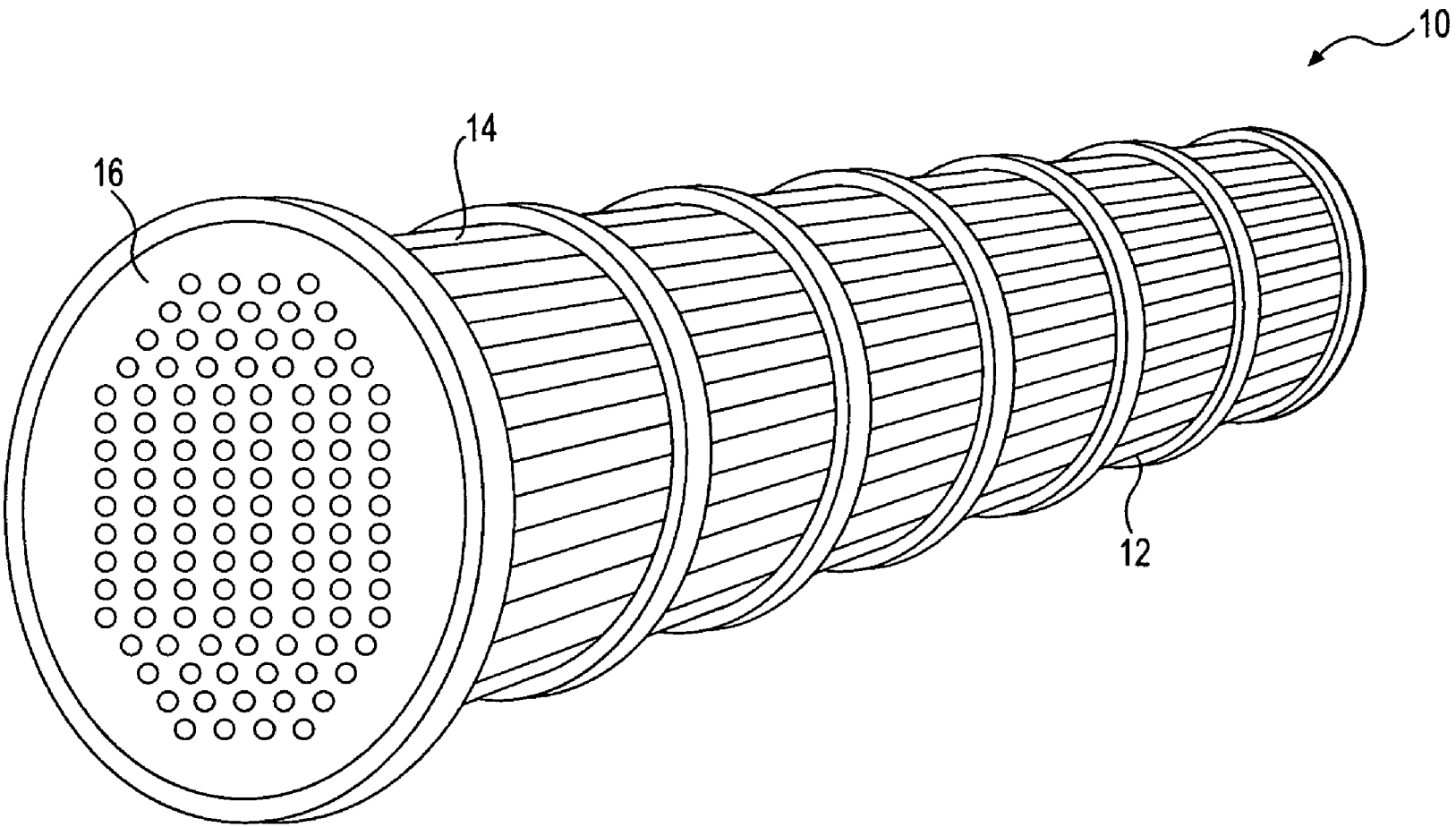
FIG. 1 is a side perspective view of a shell-tube heat exchanger.

Referring to the drawings, FIG. 1 shows a conventional shell-tube type heat exchanger 10 in which a bundle 12 of individual tubes 14 are supported by at least one tube sheet flange 16. The bundle 12 is retained within a shell 18, seen in FIG. 2, that has an inlet and outlet (not shown) so that one fluid flows inside of the tubes while another fluid is forced through the shell and over the outside of the tubes to effect a heat exchange, as is known. As described above in the background section, the wall surfaces of the tubes, including both inside and outside surfaces, are susceptible to fouling or the accumulation of unwanted hydrocarbon based deposits.

It will be recognized by those of ordinary skill in the heat exchanger art that while a shell-tube exchanger is described herein as an exemplary embodiment, the invention can be applied to any heat exchanger surface in various types of known heat exchanger devices. Accordingly, the invention should not be limited to shell-type exchangers.

Figure 2:
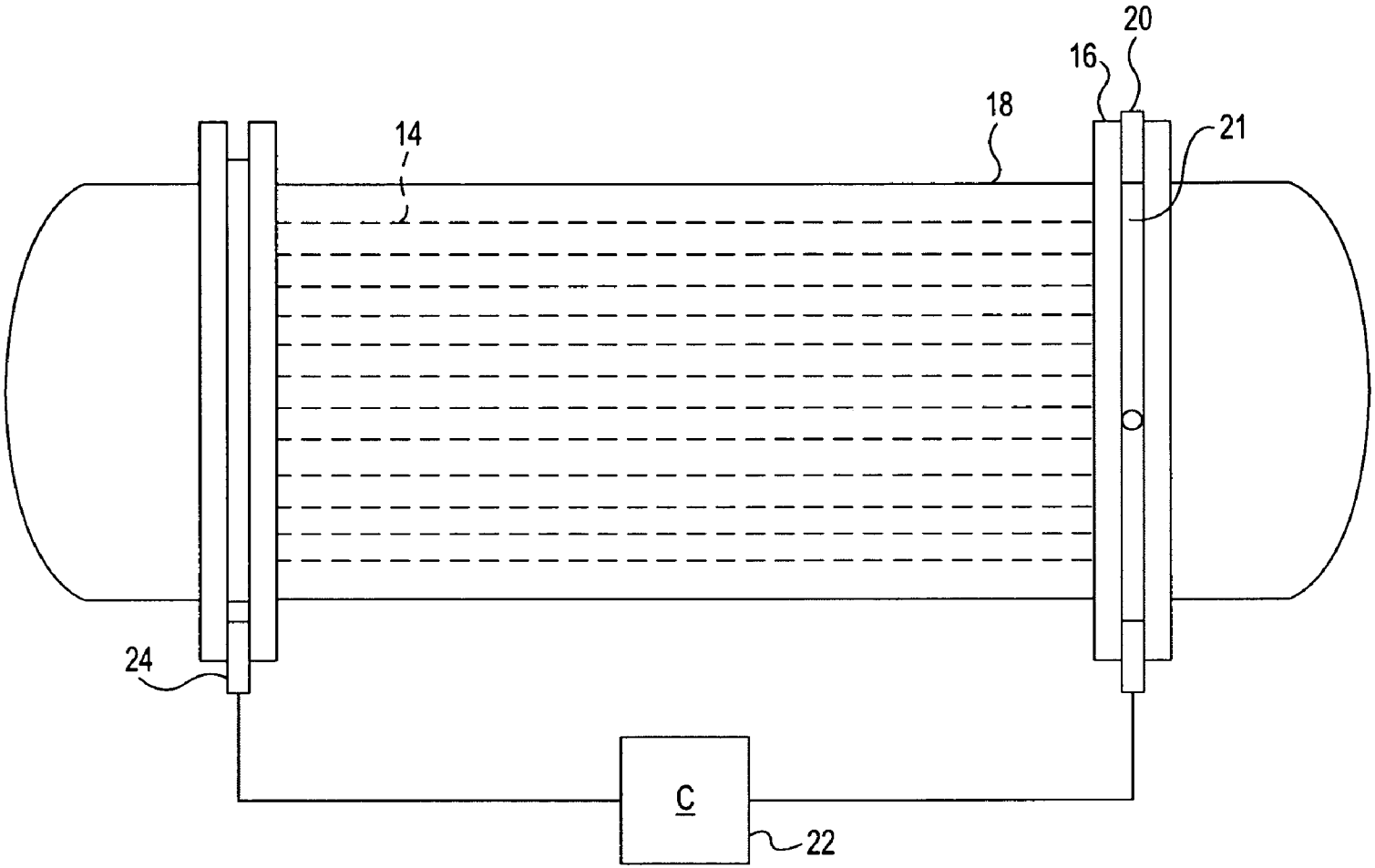
FIG. 2 is a side view of a shell-tube heat exchanger with a mechanically induced vibration system in accordance with this invention.

FIG. 2 shows a preferred embodiment of the invention in which a dynamic actuator 20 is added to the heat exchanger 10. The dynamic actuator 20 is positioned at the flange 16 of the exchanger 10 to impart controlled vibrational energy to the tubes 14 of the bundle 12. A mounting device 21 couples the dynamic actuator 20 to the flange 16. A controller 22 is preferably in communication with the dynamic actuator 20 to control the forces applied to the heat exchanger 10. A sensor 24 coupled to the heat exchanger 10 can be provided in communication with the controller 22 to provide feedback for measuring vibration and providing data to the controller 22 to adjust the frequency and amplitude output of the dynamic actuator 20 to achieve shear waves in the fluid adjacent the tubes to mitigate fouling while minimizing the negative effect of the applied force on the structure integrity.

The controller 22 can be any known type of processor, including an electrical microprocessor, disposed at the location or remotely, to generate a signal to drive the dynamic actuator 20 with any necessary amplification. The controller 22 can include a signal generator, signal filters and amplifiers, and digital signal processing units.

The dynamic actuator 20 can take the form of any type of mechanical device that induces tube vibration while maintaining structural integrity of the heat exchanger 10. Any device capable of generating sufficient dynamic force at selected frequencies would be suitable. The dynamic actuator 20 can be single device, such as an impact hammer or electromagnetic shaker, or an array of devices, such as hammers, shakers or piezoelectric stacks. An array can be spatially distributed to generate the desired dynamic signal to achieve an optimal vibrational frequency.

Any suitable mounting device 21 can be used depending on the type of dynamic actuator 20. The mounting device 21 provides a mechanical link between the dynamic actuator 20 and the heat exchanger 10. It can be designed as a heat insulator to shield the dynamic actuator 20 from excessive heat. It could also be formed as a seismic mass. The mounting device 21 could also function as a mechanical amplifier for the dynamic actuator 20 if necessary.

The dynamic actuator 20 may be placed at various locations on or near the heat exchanger 10 as long as there is a mechanical link to the tubes 14. The flange 16 provides a direct mechanical link to the tubes 14. The rim of the flange 16 is a suitable location for connecting the dynamic actuator 20. Other support structures coupled to the flange 16 would also be mechanically linked to the tubes. For example, the header supporting the heat exchanger would also be a suitable location for the dynamic actuator 20. Vibrations can be transferred through various structures in the system so the actuator does not need to be directly connected to the flange 16.

Figure 3:
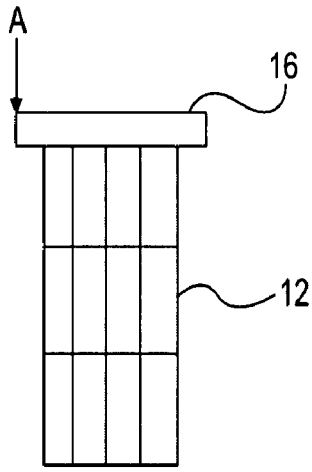
FIG. 3 is a side schematic view of a heat exchanger with the mechanically induced vibration system located at the tube-sheet flange and positioned axially with respect to the tube bundle.
Figure 4:
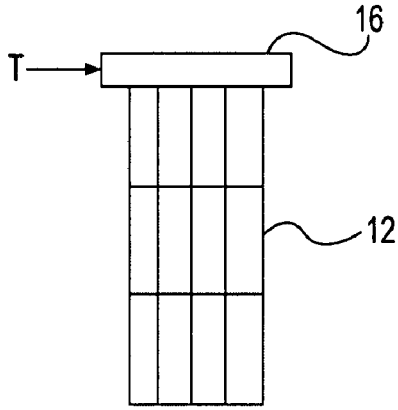
FIG. 4 is a side schematic view of a heat exchanger with the mechanically induced vibration system located at the tube-sheet flange and positioned transversely with respect to the tube bundle.
Figure 5:
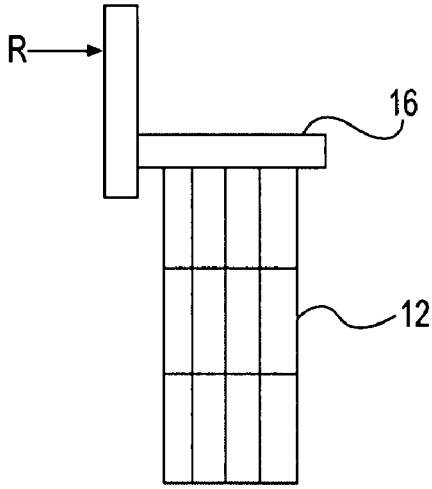
FIG. 5 is a side schematic view of a heat exchanger with the mechanically induced vibration system located remotely with respect to the tube-sheet flange.

As seen in FIGS. 3-5, the force applied by the dynamic actuator 20 can be oriented in various directions with respect to the tubes in accordance with this invention. FIG. 3 shows an axial force A applied directly to the flange 16 of the heat exchanger. FIG. 4 shows a transverse force T applied directly to the flange 16 of the beat exchanger. FIG. 5 shows a remote force R applied to a structural member connected to the flange 16 of the heat exchanger. All of the above applications of force would be suitable and would induce vibrations in the tubes 14. Various combinations of force could be used as well. For example, both transverse force and axial force can be applied to induce dual modes of vibration. Also, force applied directly to the flange 16 and force applied remotely could be used to vary the amount or type of vibration induced. Depending on the system application, the force would be controlled to maintain the structural integrity of the heat exchanger, particularly the bundle 12. The force could be applied continuously or intermittently.

Figure 6:
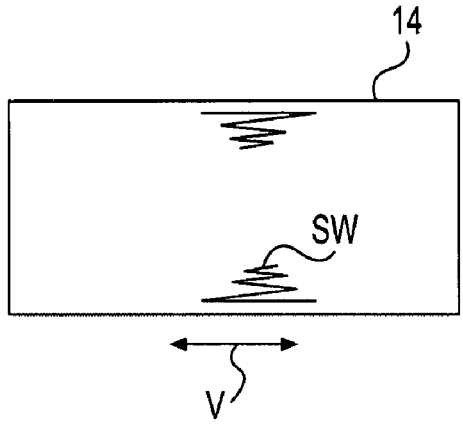
FIG. 6 is a schematic drawing of the inside of a tube showing axial wall vibration.
Figure 7:
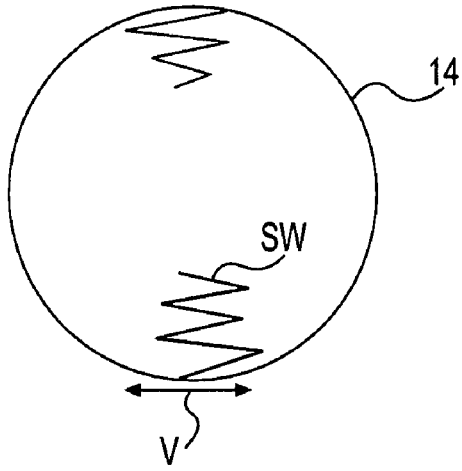
FIG. 7 is a schematic drawing of the inside of a tube showing tangential or torsional wall vibration.

In the above applications in accordance with is invention, the actuation of a dynamic force creates tube wall vibration V and corresponding shear waves SW in the fluid adjacent the walls, as seen in FIGS. 6 and 7. Certain tube vibration modes will induce oscillating shear waves of fluid near the tube wall, but the shear waves will dampen out very quickly from the wall into the fluid creating a very thin acoustic boundary layer and a very high dynamic shear stress near the wall. The dampened shear waves disrupt the relative quiescent fluid boundary layer in contact with the inside tube surface, thus preventing or reducing fouling precursors from settling down and subsequently growing and fouling.

Figure 8:
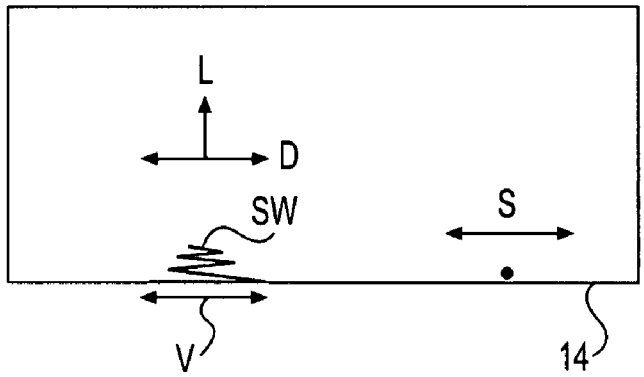
FIG. 8 is a schematic drawing showing lift, drag and shear forces inside a vibrating tube; and, FIG. 9 is a graph showing results from a test based on the inventive concept showing liquid temperature change on rod surface temperature for standard runs and a run with reduced fouling.

The inventors have determined through experimentation that mechanical vibration in accordance with this invention will considerably reduce the extent of fouling. With the proper vibration frequency, the thickness of the oscillating fluid can be made sufficiently small so that the fluid within the sub-laminar boundary layer, otherwise stagnant without shear waves, will be forced to move relative to the wall surface. The concept is shown in FIG. 8. Shear waves SW near the wall exert both drag D and lifting L forces on the precursors or foulant particles in the fluid. The dynamic drag force D keeps the particles in motion relative to the wall, preventing them from contacting the wall and thus reducing the probability of the particles sticking to the wall, which is a necessary condition for fouling to take place. At the same time, the lifting force L causes the particles to move away from the wall surface and into the bulk fluid, thus reducing particle concentration near the wall and further minimizing the fouling tendency. For a particle already adhered to the wall, the shear waves also exert a shear force S on the particle, tearing it off from the wall if the shear force is strong enough. The inherent unsteadiness of the shear waves within the boundary layer makes them more effective in reducing fouling than the high velocity effect of bulk flow. The adherence strength of a particle to the tube wall in an oscillating flow would be expected to be much lower than in a steady unidirection flow. Thus, the cleaning effect of shear waves is highly effective.

An experiment was conducted using a commercially available unit used in the petroleum industry to measure fouling known as ALCOR Hot Liquid Process Simulator (HLPS) fouling test system. The test applied vibrational excitation to a heating rod with the driving force and frequency of the vibration shaker selected to excite the heating rod with sufficient relative motion between the fluid and vibrating surface while maintaining mechanical integrity and normal operation of the ALCOR unit. The applicable frequency ranged from a few Hz to 20,000 Hz, and the acceleration force at the driving point from a fraction of g to 20 g. Other values of driving force and frequency are also considered to be effective in minimizing fouling. The procedure of selecting optimal frequency is to identify a set of the natural frequencies and modes of the heating rod and to select a driving frequency that is close but not identical to one of the natural frequencies. Alternatively, a synthesized waveform can be generated such that multiples of vibration resonance of the heating rod could be excited.

The test feed was Arab Extra Light whole crude oil run through the ALCOR HLPS under once-through conditions at 3ml/min under a nitrogen pressure using 370° C. (698° F.) surface temperature to induce fouling. The build up of foulant causes an insulating effect, much like in refinery heat transfer equipment. The insulating effect reduces the ability of the heated surface to heat the fluid, and as a result the outlet liquid temperature decreases as more foulant is deposited. The reduction in outlet temperature is measured as Outlet Delta T. This is a standard that is measured over a 3 hour (180 minutes) period. The end fouling indicator is termed ALCOR Outlet Delta T180. The Delta T180 for Arab Extra Light has been typically between −57 and −63° C. in previous ALCOR tests without vibration.

Figure 9:
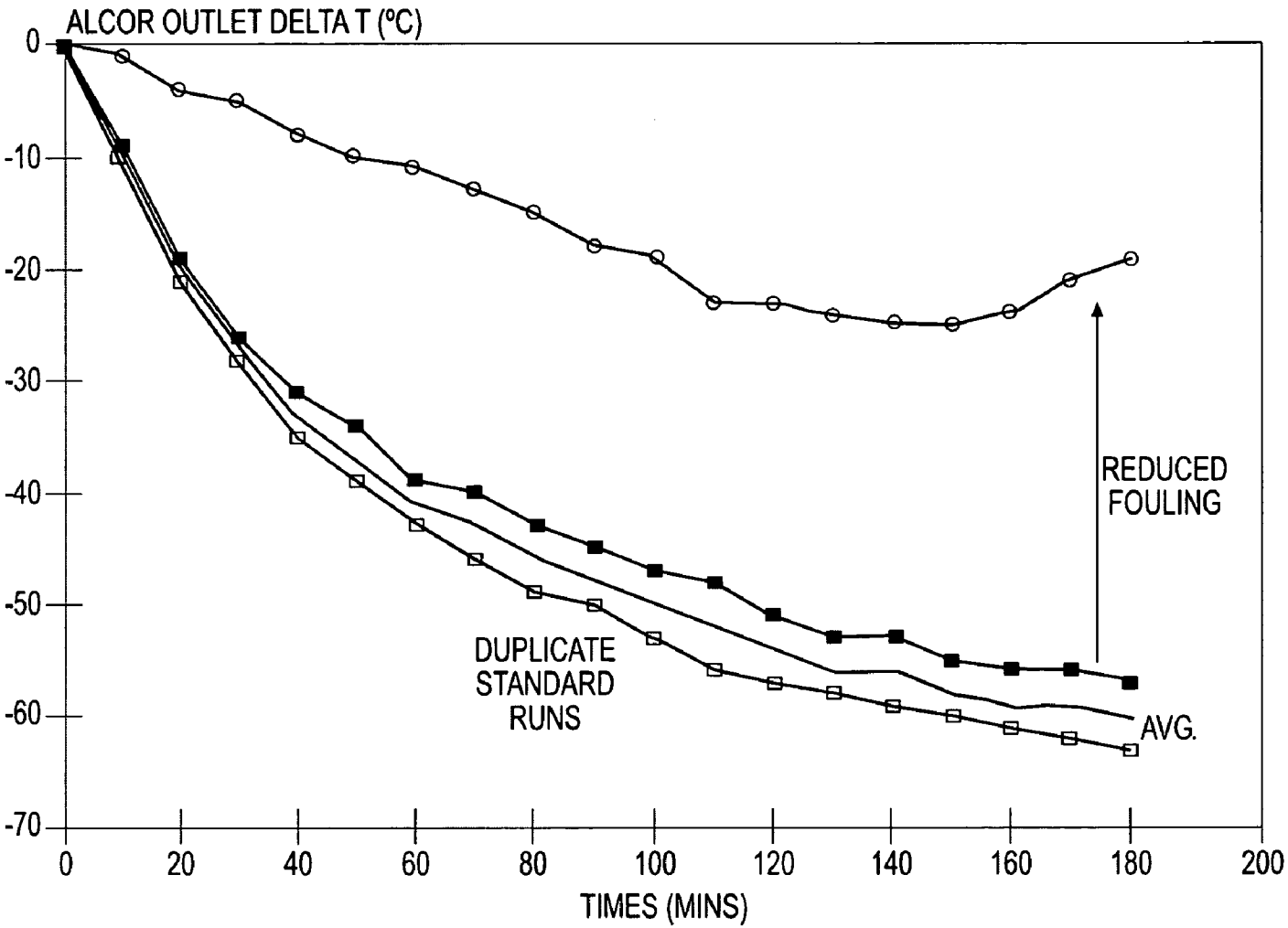

Using the above vibration parameters, vibration was induced perpendicularly to the ALCOR heating rod. The final ALCOR Outlet Delta T180 for the Arab Extra Light whole crude oil was observed to be reduced to only 19° C., as shown in FIG. 9. This represents approximately a two-thirds reduction in fouling, comparing the data obtained without vibration. The slight upturn in outlet temperature shown near the end of the run may suggest slight shearing occurred. For the test data shown in FIG. 9, the following vibration parameters were used and measured: frequency of 2.11 kHz and acceleration at driving point of 203 $m/s^2$. Deposits had collected only on opposite sides of the rod, which the inventors believe occurred due to the vibration being applied perpendicularly to the rod. It is anticipated that more beneficial effects would be observed if the vibration was applied to the rod axially.

Based on the vibration measurement and analysis of the tube bundles 12, the inventors determined that the tube-sheet flange 16 provides an effective mechanical link to the internal tubes 14 and can be used to exert mechanical excitation. Sufficient vibration energy can be transferred from the flange 16 to the tubes 14 at vibration modes. There are low and high frequency vibration modes of tubes. For low frequency modes (typically below 1000Hz), axial excitation is more efficient at transmitting vibration energy, while at high frequency modes, transverse excitation is more efficient. The density of the vibration modes is higher at a high frequency range than at a low frequency range (typically below 1000 Hz), and vibration energy transfer efficiency is also higher in the high frequency range. Further, displacement of tube vibration is very small at high frequency (>1000 Hz) and insignificant for potential damage to the tubes.

Fouling mitigation by vibration is strongly dependent on wall shear stress induced by shear waves. Therefore, wall shear stress is used as one of the primary design parameters to quantitatively evaluate the effectiveness of different excitation methods. The wall shear stress of the tube due to wall vibration can be estimated by the following equation:

$$\tau_w = CV_w\sqrt{(\rho\mu\omega)}$$

where C is a constant, ρ and μ are the fluid density and viscosity, $V_w$ is the velocity amplitude of the wall vibration, and ω is the circular vibration frequency. Assuming a reference wall shear stress above which the fouling mitigation is significant, the ratio of the tube wall shear stress to the design target is expressed by the following equation:

$$\tau_w/\tau_{ref} = (V_w/V_{ref})\sqrt{(\omega/\omega_{ref})}$$

In accordance with the experiment described above, in one example a design target for wall shear stress was selected by using a calculated wall shear stress ratio of axial and transverse tube vibration by a 750N dynamic force applied axially (parallel to the tube axis) on the flange. The same amount of dynamic force was also applied transversely (perpendicular to the tube axis) on the flange. It was shown that in both cases tube vibration could be excited to a desirable degree for purposes of fouling mitigation at most vibration modes at which the wall shear stress ratio is >1.0. The displacement amplitude (in micrometers) of tube transverse vibration was generally much smaller at frequencies of above 100 Hz than the maximum allowable vibration displacement, which is typically around 0.025 inches or 600 microns for a design that avoids tube damage by vibration. For frequencies above 1000 Hz, the dynamic displacement of the tube is negligible in terms of potential vibration damage to the tube and supports.

It is advantageous to use high frequency vibration for fouling mitigation because (1) it creates a high wall shear stress level, (2) there is a high density of vibration modes for easy tuning of resonance conditions, (3) there is low displacement of tube vibration to maintain the structural integrity of the heat exchanger, and (4) there is a low offensive noise level.

Selection of the precise mounting location, direction, and number of the dynamic actuators 20 and control of the frequency of the amplitude of the actuator output is based on inducing enough tube vibration to cause sufficient shear motion of the fluid near the tube wall to reduce fouling, while keeping the displacement of the transverse tube vibration small to avoid potential tube damage. Obviously, the addition of a dynamic actuator 20 can be accomplished by coupling the system to an existing heat exchanger 10, and actuation and control of the dynamic actuator can be practiced while the exchanger is in place and on line. Since the tube-sheet flange is usually accessible, vibration actuators can be installed while the heat exchanger is in service. Fouling can be reduced without modifying the heat exchanger or changing the flow or thermal conditions of the bulk flow.

Various modifications can be made in the invention as described herein, and many different embodiments of the device and method can be made while remaining within the spirit and scope of the invention as defined in the claims without departing from such spirit and scope. It is intended that all matter contained in the accompanying specification shall be interpreted as illustrative only and not in a limiting sense.

What is claimed is:

1. A process for reducing crude oil fouling in a heat exchanger, comprising:

providing a heat exchanger with tubes for liquid flow and a fixed mounting element that supports the tubes;

providing a flow of crude oil through the heat exchanger;

providing a dynamic actuator connected to the fixed mounting element, wherein the dynamic actuator including a force producing device for generating a mechanical force;

applying a mechanical force to the fixed mounting element through operation of the dynamic actuator to induce a vibration in the tubes that causes shear motion in the crude oil flowing adjacent to the tubes to reduce fouling of the tubes;

controlling the application of mechanical force to induce controlled vibrational energy by controlling frequency and amplitude output of the dynamic actuator;

sensing vibrational energy induced in the tubes; and adjusting control of the application of mechanical force based on the sensed vibrational energy.

2. The process of claim 1, wherein providing a heat exchanger includes providing a shell-tube heat exchanger with the tubes formed as a tube bundle and the fixed mounting element formed as a tube-sheet flange.

3. The process of claim 1, wherein applying the mechanical force includes applying the force directly to the fixed mounting element.

4. The process of claim 1, wherein applying the mechanical force includes applying the force indirectly to the fixed mounting element.

5. The process of claim 1, wherein applying the mechanical force includes applying the force to a structural component connected to the fixed mounting element.

6. The process of claim 1, wherein applying the mechanical force includes applying the force in an axial direction with respect to the tubes.

7. The process of claim 1, wherein applying the mechanical force includes applying the force in a transverse direction with respect to the tubes.

8. The process of claim 1, wherein controlling the frequency includes inducing vibration at a high frequency of 1000 Hz or greater.

9. The process of claim 1, wherein applying the mechanical force includes actuating a shaker.

10. The process of claim 1, wherein applying the mechanical force includes actuating a piezoelectric stack.

* * * * *